United States Patent [19]

Bradshaw

[11] 4,398,452

[45] Aug. 16, 1983

[54] ENERGY RECOVERY HEAT EXCHANGER INSTALLATION

[75] Inventor: Norman F. Bradshaw, Richmond, England

[73] Assignee: Haden Schweitzer Corporation, Madison Heights, Mich.

[21] Appl. No.: 205,488

[22] Filed: Nov. 10, 1980

[51] Int. Cl.[3] ..... B05C 15/00

[52] U.S. Cl. ..... 98/115 SB; 62/314; 165/72

[58] Field of Search ..... 62/314; 165/5, 95, 72, 165/DIG. 12; 98/115 SB, 115 R; 118/326, DIG. 7; 55/DIG. 18, DIG. 36

[56] References Cited

U.S. PATENT DOCUMENTS

| | | | |
|---|---|---|---|
| 2,040,828 | 5/1936 | Bright et al. | 62/314 X |
| 2,185,964 | 1/1940 | Larreco | 62/314 X |
| 2,752,124 | 6/1956 | Nofziger | 62/314 |
| 2,817,959 | 12/1957 | Lustwerk et al. | 62/314 X |
| 4,173,924 | 11/1979 | Bradshaw | 98/115 SB |
| 4,273,733 | 6/1981 | Kals | 62/314 X |

FOREIGN PATENT DOCUMENTS

| | | | |
|---|---|---|---|
| 870125 | 3/1953 | Fed. Rep. of Germany | 62/314 |
| 273333 | 1/1928 | United Kingdom | 165/72 |
| 914273 | 1/1963 | United Kingdom | 165/5 |

*Primary Examiner*—Albert J. Makay
*Assistant Examiner*—Harold Joyce
*Attorney, Agent, or Firm*—Krass, Young & Schivley

[57] ABSTRACT

An installation for energy recovery heat exchangers arranged to transfer heat into or out of air exhausted from an air handling system for paint spray booths. The system includes a collection chamber about which the intakes of a series of exhaust fans are arranged to draw exhaust air into an exhaust stack. Pairs of inclined wetted surface coil sets are mounted in the walls of the enclosures, each in communication with the intake of an exhaust fan so as to receive air flow of each exhaust fan. Each of the enclosures is provided with an access door to enable cleaning and other maintenance chores to be carried out on the coil sets and pivotally mounted blocking panels may be positioned to close off air flow across the coils and bypassing of the exhaust flow through the access doors in the event excessive overspray solids are present in the exhaust flow.

3 Claims, 6 Drawing Figures

ENERGY RECOVERY HEAT EXCHANGER INSTALLATION

BACKGROUND DISCUSSION

With the increasing emphasis on energy efficiency, greatly expanded efforts have been made to recover the energy value of waste heat developed in industrial processes and also to recover the energy value of conditioned air which is exhausted from buildings or industrial processes. The energy represented in such conditioned air may be heat energy or the energy value represented by cooled air. That is, if the air supply is heated to a temperature above ambient or cooled to a temperature under ambient, the energy expended in heating or cooling such air if recovered will improve the efficiency of the conditioning process.

An example of such application is described in U.S. Pat. No. 4,173,924 of the present inventor and assigned to the same assignee as the present application, in which the air supplied to industrial paint spray booths is conditioned to a controlled temperature and humidity range, and the entire air flow is then exhausted to the atmosphere. The nature of such installation is such that enormous volumes of air flow must be conditioned and consequent enormous energy expenditures are required in heating or cooling the supply air.

In the aforementioned U.S. patent, the air exhausted from the paint spray booths is described as being highly filtered by a hydrodynamic filtration system disclosed in application Ser. No. 851,253, filed Nov. 14, 1977, now U.S. Pat. No. 4,222,319, and assigned to the same assignee as the present application. Such filtration system substantially eliminates paint overspray solids from the exhausted air, which in turn enhances the feasability of using air-to-liquid heat exchangers such as fin-on-tube coils through which the exhaust air from the paint spray booths may be passed in order to transfer heat out of or into any energy recovery system.

According to the energy recovery system disclosed in the aforementioned U.S. patent, heat is transferred into and out of the exhaust air flow during summer and winter conditions, respectively, upon circulation of the heat transfer liquid through the recovery coils or tubes and caused to be circulated over either the evaporator or condenser of a heat pump to thus efficiently recover relatively high proportions of the energy in such exhausted conditioned air.

While such air flow is substantially free from such overspray paint solids, 100% removal thereof is not possible. Given the enormous volume of air flow common in such systems, some accumulation of air solids of such heat recovery coils could be expected requiring regular maintenance in cleaning the coils in order to insure operation at an optimum degree of efficiency.

This is particularly necessary during summertime operation since the temperature differential from the incoming and ambient air is relatively slight, and a high degree of efficiency of the heat exchanger is required to enable transfer of sufficient heat energy into the coils.

It would be advantageous to increase the efficiency of such fin-on-tube coil arrangements for operation at relatively low temperature differentials thereacross.

The presence of slight concentrations of particulates has also led to the arrangement of an exhausting system including collecting of the exhaust flows from a number of such spray booths in a common chamber and the arrangement of a number of such fans drawing in air from the collection chamber and thence into an exhaust stack such as to direct the exhaust air upwardly at considerable velocity in order to disperse the overspray particulates remaining after filtration.

The aerodynamic efficiency of such arrangements has been affected by problems of flow distribution to such plurality of exhaust fans, since the intakes of such fans having been located at varying distances from the entrance location of the exhaust ducting.

Also, the outlets have commonly been arranged in a crossing pattern, creating considerable turbulent losses in the exhaust stack.

Sometimes it happens that difficulties are encountered in the operation of the filtration system such that a larger than normal concentration of paint solids are contained in the exhaust. In such cases, solid concentrations may reach levels resulting in the fouling of the energy recovery coils and it would be advantageous if in such installation of energy recovery coils these coils could be bypassed quickly such as to preclude such fouling.

Accordingly, it is an object of the present invention to provide an arrangement and installation for such energy recovery heat exchangers in an air exhaust flow in which maintenance and other cleaning operations on such coils are simplified.

It is yet another object of the present invention to provide such energy recovery coil installation in an exhaust system for paint spray booths of the type described, i.e., in which a plurality of exhaust fans are arranged about a collection chamber, the air flow being directed from such chamber into an exhaust stack or chimney.

It is still another object of the present invention to provide such exhaust system in which high aerodynamic efficiency of the exhaust flow is achieved.

It is another oabject of the present invention to provide an arrangement whereby the energy recovery coils may be readily bypassed in the event malfunction of the filtration system would result in damage to the energy recovery coils.

It is a further object of the present invention to provide an arrangement for such energy recovery coil in which a high degree of heat transfer efficiency is maintained.

SUMMARY OF THE INVENTION

These and other objects of the present invention, which will become apparent upon a reading of the following specification and claims, are achieved by an installation arrangement in which the energy recovery coils are installed immediately upstream of the air to be exhausted such that the exhaust air is drawn through the energy recovery coil set and thence directed into the exhaust stack.

In the preferred embodiment, the energy recovery coil sets are mounted in an enclosure, the interior of which is in communication with the exhaust fan intake with a pair of coil sets mounted alongside thereof in a generally V-shaped configuration, and with an access door provided in an endwall of the enclosure enabling entry thereinto by maintenance personnel for cleaning of the energy recovery coil sets.

Also provided are hinged blocking panels which are adapted to be swung down to cover the upstream face of each of the coil sets so that the access door may act as a bypass opening enabling bypassing of the flow directly to the exhaust fan intake.

Each of the coil sets is preferably of a wetted surface design in which spray nozzles are arrayed across the upstream and/or downstream faces thereof to enhance the transfer of heat thereinto during summertime conditions by causing the evaporation of water from the coil surfaces to in turn cause the transfer of latent heat value of the water into the air exhaust.

Also preferably incorporated is a perforate plate disposed immediately upstream of each coil in the coil sets.

According to the invention which is the subject matter of copending application Ser. No. 205,479, filed Nov. 10, 1980, now abandoned, the excess water drains off the coils and collects on the surface of the plate. The air jets formed by the air flowing through the plate perforations entrains water droplets and augments the spray nozzle wetting of the tubes and fins of the various coils.

The energy recovery coils are arranged in an array extending about the periphery of a central collection chamber receiving the exhaust air flow from upstream in the system, from a plurality of heat spray booths in the application disclosed. A plurality of exhaust fans each having an intake entering into the collection chamber via the respective recovery coil enclosures are arrayed about the chamber, with their exhaust outlets emptying into a common exhaust stack.

The resistance to air flow presented by each coil set enables more even distribution of the flow from the central collection chamber to the respective exhaust fan intakes for higher efficiency operation of the exhaust fans.

A "back washing" of a respective coil set is enabled by shutting down one of the plurality of independently operable exhaust fans to cause a backflow out from the common exhaust stack through the coil sets associated with the shutdown exhaust fan, upon continued operation of the remaining exhaust fans.

The arrangement of each of the exhaust fan outlets is such as to provide an essentially noncrossing flow pattern of each of the exhaust fan outlets to further enhance the aerodynamic efficiency in the operation of the exhaust fans. The pattern of the preferred embodiment comprises a chamber having sides at obtuse angles to each other, disclosed as a chamber with each of the exhaust fan outlets directed outwardly from the sides in a converging pattern.

Also disclosed is an arrangement whereby the exhaust fan outlets are upwardly inclined at a 45° angle to the horizontal to be directed into the exhaust stack.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figures 1, 6:
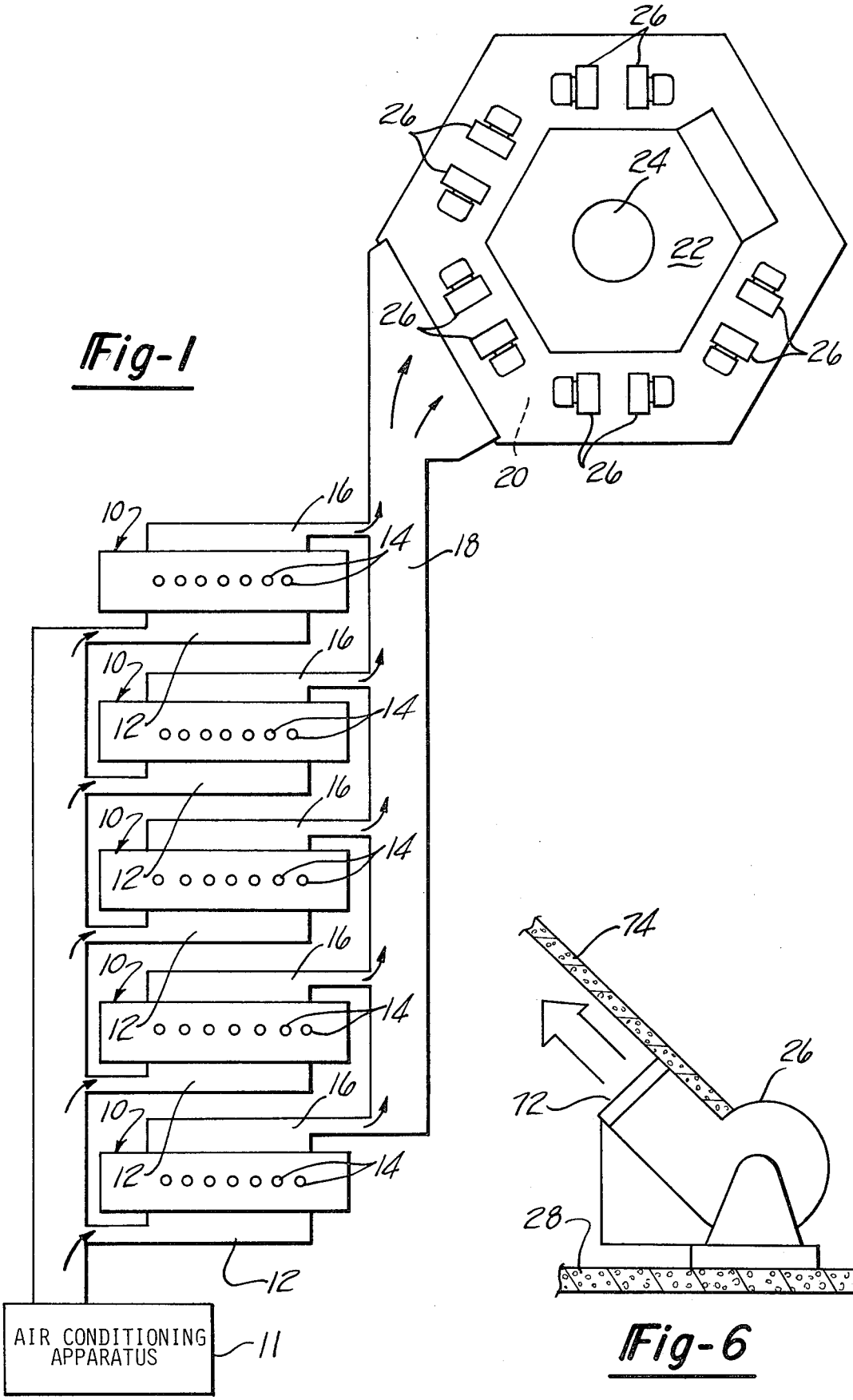
FIG. 1 is a plan diagrammatic view of an air exhaust system associated with a plurality of paint spray booths depicting the collection chamber and exhaust stack with which the energy recovery coil installation according to the present invention is associated.
FIG. 6 is a fragmentary view of an alternate embodiment of the present invention revealing an alternate installation of the exhaust fans with respect to the exhaust chimney or stack structure.

Referring to the drawings and particularly FIG. 1, the energy recovery heat exchanger installation according to the present invention is depicted as incorporated into an air handling system for a series of paint spray booths 10 provided with conditioned air via supply ducts 12 typically conditioned as to temperature and humidity of air conditioning apparatus 11 which may be of the type described in U.S. Pat. No. 4,173,924. The supply ducts 12 are placed in communication with a ceiling plenum in the arrangement described in that patent, passes out through a hydrodynamic filtration system comprised in part by a series of floor-mounted tubes 14 through which water drains, as well as the air exhaust. The air exhausted passes outwardly to exhaust duct 16.

During wintertime conditions, the ambient air will typically be heated and humidified by the conditioning apparatus and during summertime operation will typically be cooled and dehumidified prior to being supplied to the system paint spray booths.

The exhaust air flow in exhaust duct 16 passes into a collector duct 18 and thence is conveyed into a collection chamber 20 disposed beneath an exhaust plenum 22 having an exhaust stack 24 mounted atop thereof.

The exhaust flow is drawn out of the collection chamber 20 by a series of exhaust fans 26 arranged in locations disposed about the periphery of the collection chamber 20.

Figure 3:
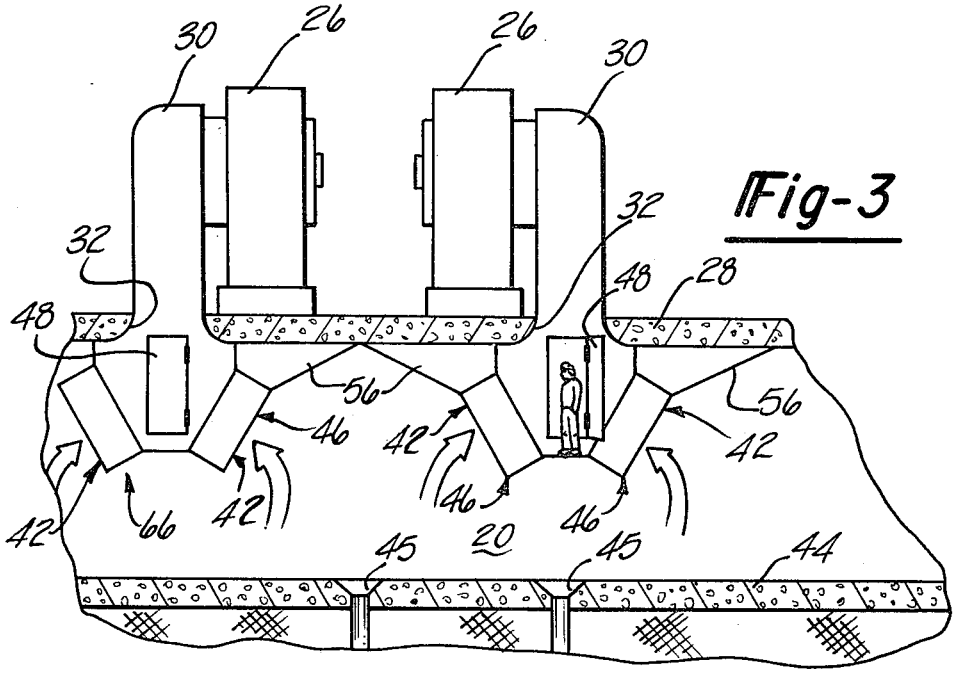
FIG. 3 is a transverse sectional view taken through the collection chamber shown in FIG. 2.

In the system depicted, the exhaust duct 18 and collection chamber 20 are each subterranean, i.e., below the level of the floor 28, as seen in FIG. 3. Each of the exhaust fans 26 is provided with an inlet hood 30 in communication with a rectangular opening 32 formed in the floor 28. Pairs of the exhaust fans 26 and openings 32 and hoods 30 are arrayed along each side of the hexagonally shaped collection chamber 20. Located atop the floor 28 is an exhaust plenum 34 in communication with a centrally located exhaust stack 36 in which an exhaust outlet 38 of each of the exhaust fans 26 is directed. Deflectors 40 are also included in order to cause the outflow from each exhaust fan 26 to be diverted in a generally upward direction and converging into the exhaust stack 36. It can be seen that the exhaust flow from each exhaust fan 26 is generally convergent, but due to the obtuse angle between each side, each outflow does not substantially cross the outflow from adjacent fan exhausts.

Positioned below each opening 32 is a sheet metal enclosure 42, the interior of each in communication with a respective opening 32 and intake hood 30. The sheet metal enclosure 42 is suspended beneath the floor 28 and above the surface of floor 44 of the collection chamber 20.

Suitable floor drains 45 are normally provided in such enclosures to drain away collected moisture and facilitate cleanout, as will be described hereinafter.

Each of the enclosures 42 has mounted alongside thereof energy recovery heat exchangers 46 comprising fin-on-tube coil sets arranged to form a V-shape with each other. Each enclosure 42 is also provided with an access door 48 at one or both ends thereof to provide access to the interior of the enclosures 42, for maintenance, cleanout and other similar purposes.

Figure 4:
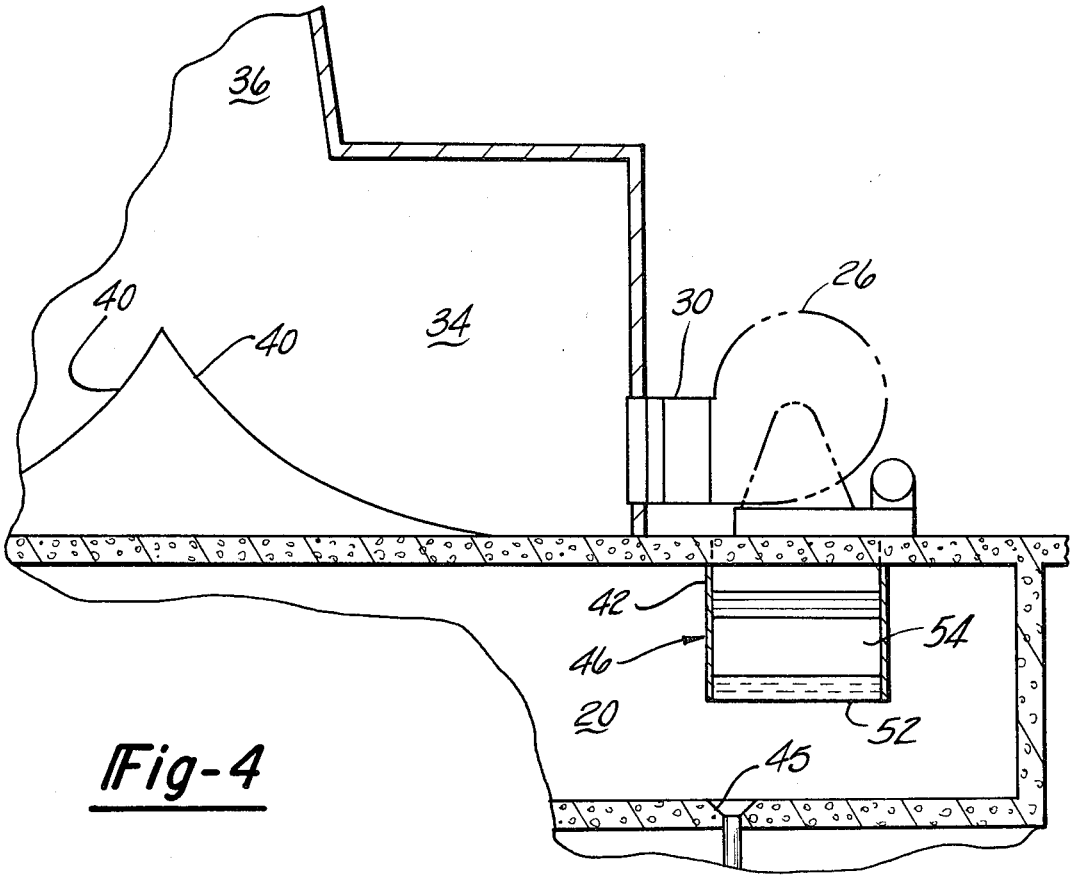
FIG. 4 is a view of a radial section taken through the collection chamber and exhaust stack shown in FIG. 2.

Referring to FIG. 4, the details of a typical heat exchanger 46 are revealed. The upstream side 52 receives inflow from the collection chamber 20, thence into the interior 54 of the enclosure 42, and finally out through the intake hood 30. The flow resistance presented by each heat exchanger 46 tends to balance and stabilize the flow to each exhaust fan 26 improving the aerodynamic efficiency thereof.

In order to selectively block off one or all of the energy recovery heat exchangers 46, hinged blocking panels 56 are provided which are each adapted to be pivoted down to overlie the upstream side 52 of a respective coil set 46. After opening of the access door 48 of the respective enclosures 42, the exhaust flow is enabled to bypass the energy recovery heat exchangers 46. This may be advantageous if excessive particulate content in the exhaust flow occurs due to system malfunction since severe fouling of coil surfaces may otherwise result.

Figure 5:
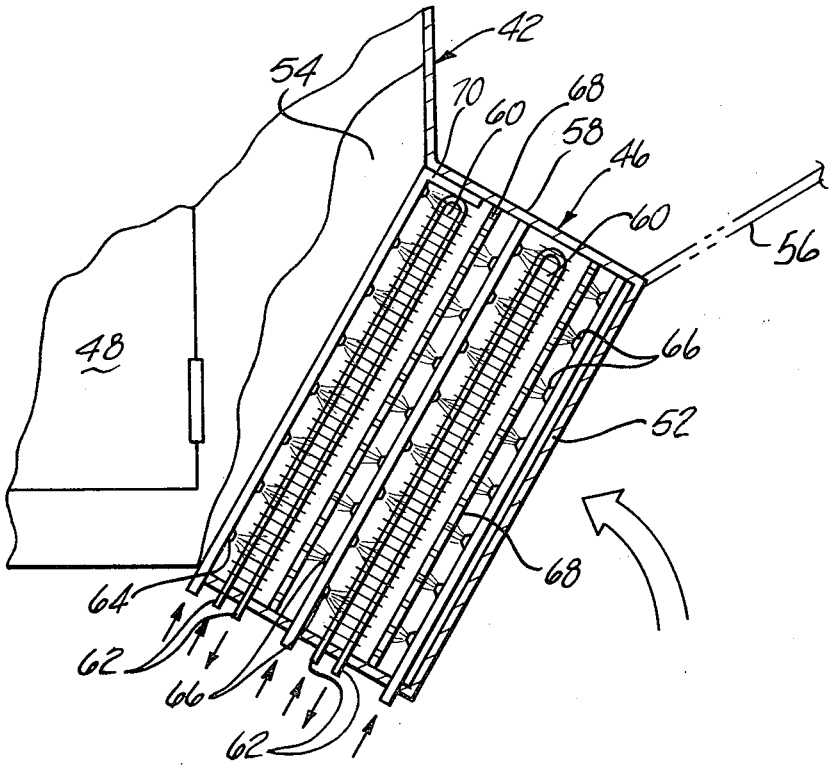
FIG. 5 is an enlarged partially sectional view taken through one of the energy recovery coil enclosures incorporated in the installation shown in FIGS. 1 through 3.

Referring to FIG. 5, the details of a representative embodiment of the energy recovery heat exchanger 46 is depicted which includes an outer enclosure 58 forming a through flow passage to enable air flow of exhaust flow through and into the interior of the enclosure 42.

In a preferred embodiment, sets of fin-on-tube coils 60 are employed each comprising a stacked series of such fin-on-tube coils 60 mounted within the outer enclosure 58. Suitable liquid transfer media lines 62 are provided for each of the coils 60, directed to the evaporator-condenser of a suitable heat pump for the application described.

The transfer of heat into the coils 60 is greatly enhanced by maintenance of a wetted condition of the coil 60 surfaces. The wetted surface condition results in evaporation of the water which passes into the exhaust air and the latent heat of the evaporated water is absorbed by the air exhaust flow and transferred out of the liquid circulated through each of the coils 60.

The wetting of the surface must be carefully controlled, since if the surfaces are flooded, maximum evaporation and heat transfer will not take place.

In addition, the maintenance of surfaces of the coils 60 in a wetted condition substantially minimizes the accumulation thereon of any overspray solids contained within the exhaust flow. It has been discovered that any such accumulation is thereby confined to the leading row of fins in each coil 60 such as to enable relatively easy cleaning by back flow through the coils and by brushing of these surfaces.

In order to provide such wetting, one or more nozzle arrays such as downstream nozzles 64 and upstream nozzles 66 may direct streams of water spray into the interior of each coil 60.

As described more completely in copending application Ser. No. 205,479, filed Nov. 10, 1980, now abandoned, it has also been discovered by the inventor named in that application that the provision of a perforate plate, here shown as 68, downstream of nozzles 66 and upstream of coil 60 causes a very effective diffusion or dispersion of water droplets into the air flow by jetting action of air flowing through the perforations and through the film of water collecting or flowing on the perforate plate 68. This provides a complete wetting of the coil fin-on-tube surfaces completely into the interior thereof to greatly enhance the efficiency of heat transfer out of the coils 60.

Towards this end, a flooding tube 70 may be provided in order to secure a flow of water across the upper surface of the respective perforate plates 68.

In order to further improve the flow characteristics of the exhaust flow into the exhaust stack 36, both radially and axially converging exhaust outlets 72 are provided for the exhaust fans 26, and a converging wall structure 74 is provided for the exhaust plenum and stack. The outlets are angled at 45° above the horizontal (FIG. 6).

Figure 2:
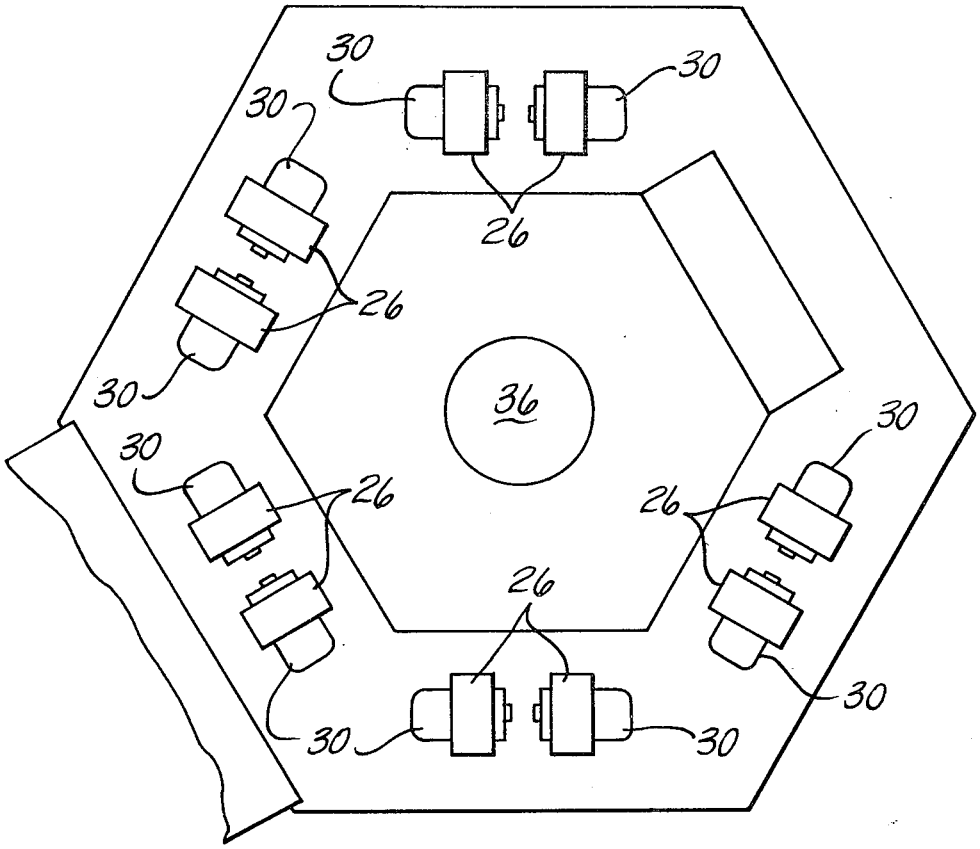
FIG. 2 is an enlarged plan view of the collection chamber and exhaust fan.

Thus, crossing flow from the exhaust outlets 72 is further minimized over the arrangement shown in FIGS. 1 and 2.

It can thus be appreciated that the above-recited objects of the present invention have been provided by the mounting installation described. That is, mounting of the energy recovery heat exchangers 46 in the enclosure in the V inclination with respect to each other provides a large cross sectional area for flow therethrough. At the same time, the provision of the access door 48 to the enclosure enables readily convenient access to the coils for cleaning and other maintenance purposes, the V mounting disposing these coils so as to be readily accessible to workmen.

The provision of the blocking panels when combined with such access door to each enclosure enables a relatively simple means for bypassing the flow of the mounting installation. When a plurality of such heat exchangers is combined with a series of independently operable exhaust fans arranged to draw flow through the intakes and the respective energy recovery coils, this makes possible the simple back wash of each of the coils by simply shutting off the associated fan, and the higher air pressure in the exhaust plenum space creates flow out through the heat exchanger coil for clearing of the surfaces by such backflow.

In addition, the resistance provided by the coils at the intake of the various exhaust ends enables an even distribution of flow through each of the exhaust fans to improve the efficiency of such systems incorporating a plurality of exhaust fans each having an intake in communication with a common space.

The provision of the subterranean collection chamber 20 having the floor drain 45 enables the use of wetted surface coils and convenient cleanup after cleaning and access to the coil surfaces or removal thereof.

All of these factors provide relatively high efficiency operation of the coils to enable adequate heat transfer even at relatively low temperature differentials.

Finally, the arrangement of the exhaust outlets from each of the exhaust fans is arranged to provide a relatively noncrossing flow to yield the higher operating efficiency of the exhaust fan, as described.

The embodiments of the invention in which an exclusive property or privilege is claimed are defined as follows:

1. A system for recovering energy out of exhaust air from the site of an industrial operation such as painting comprising:

an exhaust air collection passage;

an exhaust air disposal passage;

recovery means mediate said collection and disposal passages and comprising a substantially horizontal partition, a fabricated metal enclosure depending from said partition into said collection passage and first and second heat exchanger units secured to said enclosure; each enclosure having two intake openings through which air may flow from said collection passage into said enclosure;

said units being disposed in reversely symmetrical inclined relationship with one another such that the lower ends thereof are converging;

a normally closed access door into said enclosure mediate said units, selectively actuable cover means on said units for covering the intake openings thereof, with said cover means in place on said intake openings and said access door open, air is directed through said access door and bypasses said units; and turbine means down stream of said units for causing air to move from said collection passage into said enclosure and thence to said disposal passage.

2. Apparatus as defined in claim 1 wherein each of said heat exchanger units comprises at least one finned tube and means for spraying liquid onto said finned tube.

3. Apparatus as defined in claim 2 wherein said collection passage comprises a floor and drain means in said floor.

* * * * *